US008544201B2

(12) United States Patent
Chudwin

(10) Patent No.: US 8,544,201 B2
(45) Date of Patent: Oct. 1, 2013

(54) FIREARM SAFETY DEVICE AND METHOD FOR USING SAME

(76) Inventor: Jeffrey L. Chudwin, Frankfort, IL (US)

( * ) Notice: Subject to any disclaimer, the term of this patent is extended or adjusted under 35 U.S.C. 154(b) by 0 days.

(21) Appl. No.: 12/985,485

(22) Filed: Jan. 6, 2011

(65) Prior Publication Data

US 2011/0126442 A1 Jun. 2, 2011

Related U.S. Application Data

(63) Continuation of application No. 11/670,273, filed on Feb. 1, 2007, now Pat. No. 7,886,472, which is a continuation of application No. 10/448,695, filed on May 30, 2003, now abandoned.

(60) Provisional application No. 60/384,697, filed on May 31, 2002.

(51) Int. Cl.
*F41A 17/42* (2006.01)

(52) U.S. Cl.
USPC ..... 42/70.11; 42/66

(58) Field of Classification Search
USPC ..... 42/70.11, 66, 70.01
See application file for complete search history.

(56) References Cited

U.S. PATENT DOCUMENTS

| | | | | |
|---|---|---|---|---|
| 835,349 | A | 6/1911 | Deming | |
| 2,997,802 | A | 8/1961 | Robbins | |
| 3,086,265 | A * | 4/1963 | Orenick et al. | 24/30.5 P |
| 3,368,297 | A * | 2/1968 | Lentz | 42/70.07 |
| 3,536,160 | A | 10/1970 | Brewer | |
| 3,609,790 | A | 10/1971 | Butch | |
| 3,634,963 | A | 1/1972 | Hermann | |
| 3,708,901 | A | 1/1973 | Wolter | |
| 3,710,490 | A | 1/1973 | Cornett et al. | |
| 4,412,397 | A * | 11/1983 | Bayn | 42/70.11 |
| 4,945,665 | A | 8/1990 | Nelson | |
| 5,062,233 | A | 11/1991 | Brown | |
| 5,099,596 | A | 3/1992 | Butler, Jr. | |
| 5,331,759 | A | 7/1994 | Marceau et al. | |
| 5,410,832 | A | 5/1995 | Barnhart | |
| 5,412,959 | A | 5/1995 | Bentley | |
| 5,515,580 | A | 5/1996 | McHenry, Jr. | |
| 5,588,242 | A | 12/1996 | Hughes | |
| 5,621,996 | A | 4/1997 | Mowl | |
| 5,768,816 | A | 6/1998 | Rassias | |
| 5,775,021 | A | 7/1998 | Weiss | |
| 5,785,289 | A | 7/1998 | Shieh | |
| 6,212,813 | B1 | 4/2001 | Luna et al. | |
| 6,250,008 | B1 | 6/2001 | Silver | |
| 6,276,031 | B1 | 8/2001 | Haiduk | |
| 6,418,654 | B1 * | 7/2002 | Trois et al. | 42/70.11 |
| 6,601,331 | B2 | 8/2003 | Salvitti | |
| 6,626,674 | B2 | 9/2003 | Chudwin | |
| 6,789,341 | B1 * | 9/2004 | Badura | 42/70.11 |

(Continued)

FOREIGN PATENT DOCUMENTS

GB 2200438 A 8/1988

*Primary Examiner* — Stephen M Johnson
(74) *Attorney, Agent, or Firm* — Marshall, Gerstein & Borun LLP

(57) ABSTRACT

Methods for disabling firearms and firearm safety devices designed to reduce the risk of accidental discharge are provided. Safety devices according to the present invention comprise a chamber-disabling component constructed of a flexible material. The chamber-disabling component is adapted to be inserted through an opening in the firearm into the firing chamber with partial retraction of the bolt.

11 Claims, 4 Drawing Sheets

(56) References Cited

U.S. PATENT DOCUMENTS

| | | | | |
|---|---|---|---|---|
| 7,886,472 | B2 * | 2/2011 | Chudwin | 42/70.11 |
| 7,934,297 | B2 * | 5/2011 | Williams et al. | 24/16 PB |
| 2002/0095845 | A1 | 7/2002 | Sapia | |
| 2003/0022136 | A1 | 1/2003 | Chudwin | |
| 2003/0172572 | A1 | 9/2003 | Clark | |
| 2003/0221351 | A1 * | 12/2003 | Barber et al. | 42/70.11 |

* cited by examiner

FIREARM SAFETY DEVICE AND METHOD FOR USING SAME

CROSS REFERENCE TO RELATED APPLICATION

This application is a continuation of U.S. patent application Ser. No. 11/670,273, filed Feb. 1, 2007, now U.S. Pat. No. 7,886,472 which is a continuation of U.S. patent application Ser. No. 10/448,695, filed May 30, 2003, now abandoned which claims priority to and the benefit of U.S. Provisional Application No. 60/384,697 filed May 31, 2002.

FIELD OF THE INVENTION

This invention relates generally to firearms, and more particularly to safety devices used in conjunction with firearms.

SUMMARY OF THE INVENTION

Firearm safety devices are disclosed.

In one aspect, the present invention relates to methods for disabling firearms. In one embodiment, the method comprises the steps of providing a firearm comprising a firing chamber, an opening in communication with the firing chamber and a bolt, providing a safety device comprising a chamber-disabling component constructed of a flexible material, the chamber-disabling component adapted to be inserted through the opening into the firing chamber with partial retraction of the bolt and inserting the safety device into the chamber of the firearm.

In another aspect, the present invention relates to safety devices. In one embodiment, the safety device comprises a chamber-disabling component constructed of a flexible material. The chamber-disabling component is adapted to be inserted through an opening defined in the firearm and is in communication with a firing chamber of the firearm with partial retraction of a bolt of the firearm.

BRIEF DESCRIPTION OF THE DRAWINGS

In the drawings, like reference characters generally refer to the same parts throughout the different views. Also, the drawings are not necessarily to scale, emphasis instead generally being placed upon illustrating the principles of the invention.

DETAILED DESCRIPTION OF THE INVENTION

Safety devices, according to the present invention, are useful to disable firearms that include a firing chamber, an opening in communication with the firing chamber and a bolt. These safety devices are adapted to be positioned in the firing chamber of the firearm by the user and adapted to be removed therefrom. Since the size of the firing chamber often varies from firearm to firearm, the safety device is preferably flexible enough to accommodate structural differences, while at the same time, sufficiently strong enough to withstand the pressure exerted by bolts inside the firing chamber.

Figure 1:
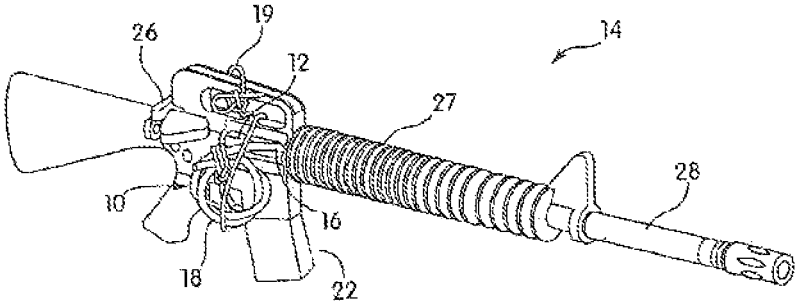
FIG. 1 is a perspective view of a firearm with a safety device of the present invention in place.
Figure 2A:
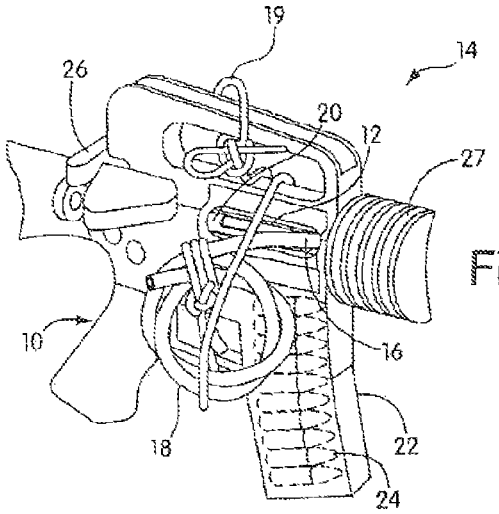
FIG. 2A is an enlarged view of a portion of the firearm of FIG. 1 with a safety device of the present invention in place. The firearm's ammunition is shown in phantom line.

Referring now to FIGS. 1 and 2A, an illustrative embodiment of a safety device 10 of the present invention is positioned within the firing chamber 12 of an automatic/semi-automatic firearm 14. The safety device 10 includes a body 16, a grasping member 18, and an attachment member 19. Referring to FIGS. 2A and 2C, the firearm 14 includes a bolt 20, a magazine 22 containing ammunition 24, a bolt-retracting member 26 for actuating a bolt 20 to feed a round of ammunition from the magazine 22 and load the round into the firing chamber 12, an ejection port 21, a handguard 27 and a muzzle 28.

Needless to say, before inserting the safety device 10 into the firearm 14, the firing chamber 12 should not contain ammunition 24. To insert the safety device 10 into the firearm 14, the user may pull back the bolt-retracting member 26 a slight amount, and then insert the body 16 through the ejection port 21 into the firing chamber 12. If the firearm 14 contains a magazine 22 with live ammunition 24, the user need not completely retract the bolt-retracting member 26 before placement of the safety device 10, because such action could load a round of live ammunition 24. Provided, however, the safety device 10 is in place, full retraction of the bolt-retracting member 26 will not chamber a round of ammunition 24 because the safety device 10 blocks the firing chamber 12. That is, the body 16 of the safety device 10 occupies space within the firing chamber 12, and prevents ammunition 24 from being able to properly position itself therein. Moreover, pulling out the safety device 10 does not allow bolt 20 to retract beyond the magazine 22 to permit a round to be fed into the firing chamber 12.

Figure 2B:
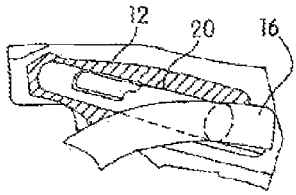
FIG. 2B is an enlarged view of the firing chamber of FIG. 2A. A portion of the bolt of the firearm is shown in phantom line.
Figure 2C:
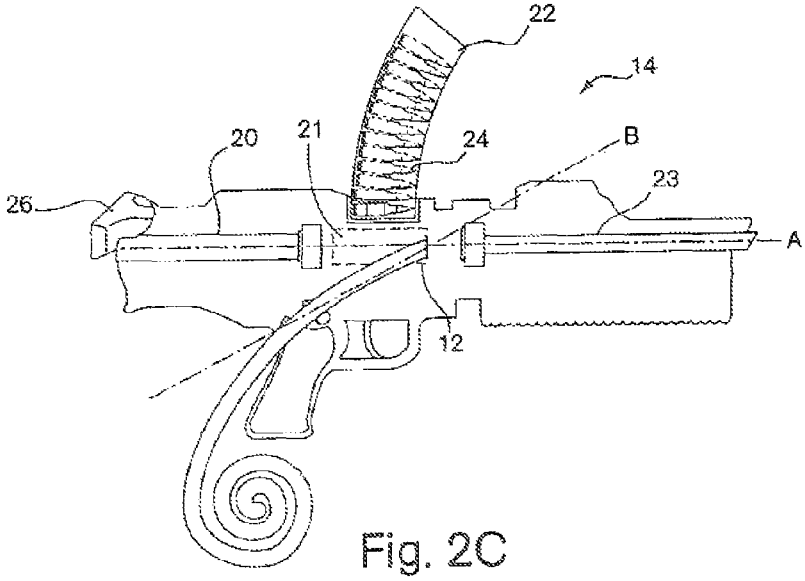
FIG. 2C is an enlarged view of the internal mechanism of a firearm with the safety device of the present invention in place.

As shown in FIG. 2B, the body 16 is positioned within the firing chamber 12 of the firearm 14, and, in one embodiment, may be abutted by the bolt 20. In this embodiment, bolt 20 helps maintain the position of the body 16 in the firing chamber 12 of the firearm 14 by exerting pressure on the safety device 10 against the sidewall that defines the beginning of the firing chamber 12. It is not necessary, however, that bolt 20 abut the body 16. In non-spring activated firearms, for example, the body 16 may be dimensioned to maintain its position within the firing chamber 12 without assistance from the bolt 20. For example, body 16 may be dimensioned so as to create an interference fit with either a dimension of the ejection port and/or an inner circumference of the firing chamber 12. In addition, the attachment member 19, which may be wrapped around the central action of the firearm 14, may help ensure that the safety device 10 does not inadvertently fall out of position.

Figure 3:
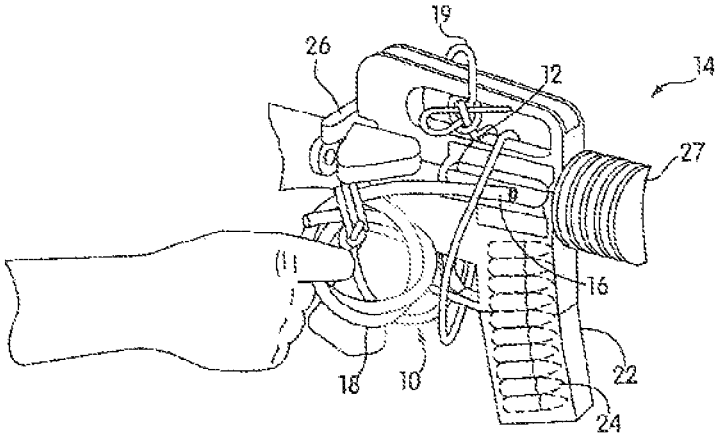
FIG. 3 is an enlarged view of a portion of the firearm with a safety device of the present invention being removed from the chamber of the firearm.
Figure 6:
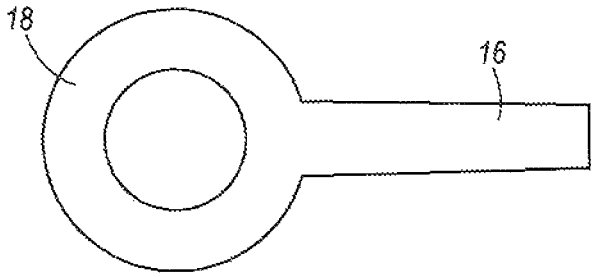
FIG. 6 is a side view of an alternative embodiment of a safety device of the present invention. The safety device is shown with a ring shaped grasping member.
Figure 7:
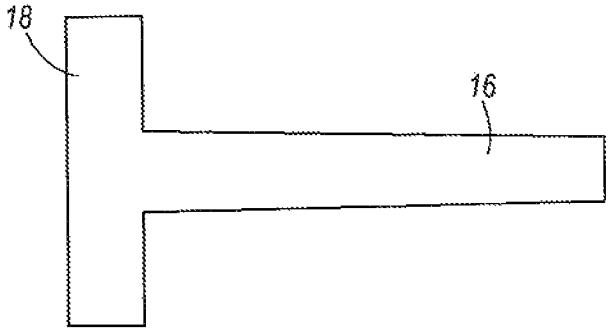
FIG. 7 is a side view of another alternative embodiment of a safety device of the present invention. The safety device is shown with a T-shaped grasping member.

Once the safety device 10 is in position, it is plainly visible to the user and others. The grasping member 18 may enhance visibility. In some embodiments, the grasping member 18 may extend out of the firing chamber 12, allowing the user to observe the safety device 10 from a distance, and easily remove it to prepare the firearm 14 for action. The grasping member 18, as shown in FIGS. 1-3, is in the form of a coil integral with the body 16. The grasping member 18 need not, however, be integral with the body 16. In fact, the grasping member 18 may take any form that allows the user to sufficiently grasp the safety device 10 for removal. The grasping member 18 may, for example, take the form of a T-shaped handle (See FIG. 7), a ring (see FIG. 6) or virtually any other structure connected to the body 16 that the user can grasp. Under any of these constructions, the grasping member 18 may assist the user in removing the safety device 10 from the firing chamber 12.

The attachment member 19 may also enhance visibility. Like the grasping member 18, the attachment member 19 may extend out of the firing chamber 12 so that users and others may see the safety device 10 from a distance. To further enhance visibility, the safety device 10, the grasping member 18 or the attachment member 19, (or portions of each), may be fluorescent in color.

Figure 5:
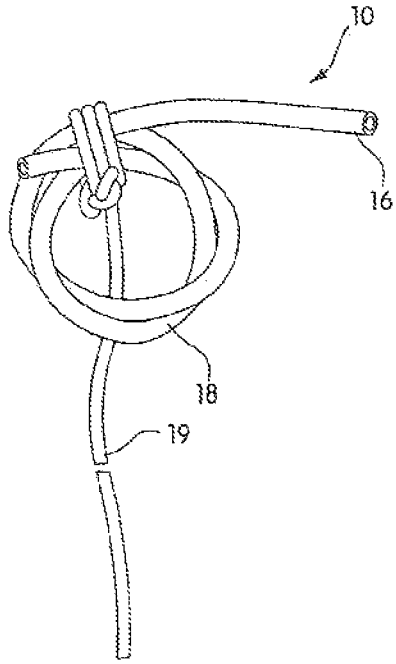
FIG. 5 is a perspective view of an attachment member secured to the safety device of the present invention.

FIG. 5 shows one attachment member 19 according to the present invention. As mentioned, the attachment member 19 may help to ensure that the safety device does not inadvertently fall out of position. In addition, the attachment member 19 allows the user to avoid losing or misplacing the safety device 10 after its removal from the firing chamber 12. After removal, the safety device 10 remains connected to the attachment member 19, which, in turn, remains secured to the firearm 14.

The attachment member 19 may be made of any suitable material or structure adapted to secure the safety device 10 to the firearm 14. Such structures include, for example, a flexible band for tying a knot (as shown in FIG. 5), an elastic band, a wire twist or a strap containing an adhesive, such as VELCRO®, available from Velcro USA, Inc. The attachment member 19 may be secured to the firearm 14 by securing it around the central action of the firearm, as shown in FIGS. 1-3. Any one or combination of ways may be employed to secure the safety device 10 to the firearm 14.

The attachment member 19 may be secured to the safety device 10 in any suitable manner, including but not limited to, melting, tying, pinning, gluing or shrink wrapping the two together. Alternatively, the attachment member 19 and the body 16 may be formed as a single unit through injection molding.

FIG. 3 depicts removal of the safety device 10 from the firing chamber 12 of the firearm 14 by a user. As those of skill in the art will appreciate, the user may remove the safety device 10, and then prepare the firearm 14 for action in two fast and easy motions. To remove the safety device 10, the user may take hold of the grasping member 18—in this case a coil—and pull it in a direction away from the firearm 14. The smooth surface of the safety device facilitates sliding of the safety feature. Since the user need not retract the bolt 20 to remove the safety device 10, the time spent removing the safety device 10 is minimal.

Minimizing removal time is particularly advantageous to users who need to defend themselves against deadly force. As shown in FIG. 3, use of the coiled grasping member 18 allows the user to remove the safety device with one finger. Such construction allows an injured or incapacitated user to remove the safety device with minimal effort, when confronted with the use of deadly force. Moreover, with the safety device 10 herein sliding out of the firing chamber 12, the bolt 20 is not moved back far enough to allow a round to enter the firing chamber 12 from the magazine 22, and cause any premature loading or jamming of the weapon. Regardless of whether the safety device 10 is secured in the firearm 14 by the action of the bolt 20 pressing against the safety device 10 or by some other method, such as an interference fit between the device 10 and a dimension of the firing chamber 12, a round of ammunition will not be placed in the firing chamber 12 by extraction of the safety device 10 from the firearm 14. The user prepares the firearm 14 for action by pulling back and releasing the bolt-activating member 26, thereby chambering a round of ammunition 24.

Figure 4:
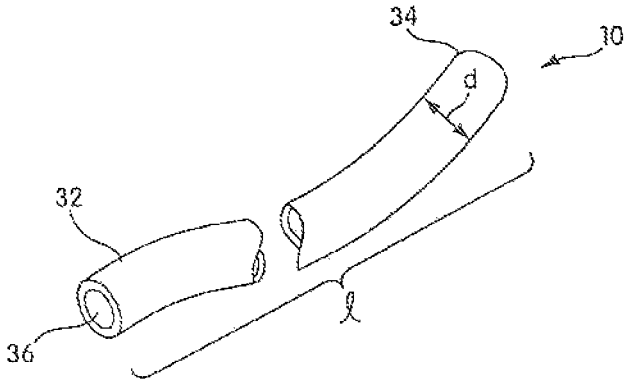
FIG. 4 is a perspective view of a broken apart illustrative embodiment of the safety device of the present invention.

FIG. 4 is a perspective view of one embodiment of a safety device 10 according to the present invention. The safety device 10 includes a body 16, a first end 32 and a second end 34. The body 16 may be elongated.

The safety device 10 may be solid or hollow. In FIG. 4, the safety device 10 is hollow with a central lumen 36 running throughout.

Either one of the first or second ends 32 and 34 of the safety device 10 may be inserted into the firing chamber 12 of the firearm 14. As shown in FIG. 2C, in one embodiment, the first or second end 32 and 34, which is not inserted into the firing chamber 12 is positionable in an angular relationship to a longitudinal axis A of the firing chamber 12. Alternatively, the first or second end 32 and 34 inserted into the firing chamber 12 is positionable in an angular relationship to a longitudinal axis B of the first or second end 32 and 34 not inserted into the firing chamber 12. The angular relationship, in either case, may be transverse.

In other embodiments, the first or second end 32 and 34 not inserted into the firing chamber 12 may extend/hang out of the firing chamber 12, allowing the user to grip the safety device 10 to remove it from the firing chamber 12. As shown in FIGS. 1-3, the first or second end 32 and 34 not inserted into the firing chamber 12 may also be wound about itself to form a coiled grasping member 18.

Referring to FIG. 4, in one embodiment of the invention, designed for operation with an M-16 or AR-15 rifle, the diameter d of the safety device 10 is between about 0.25 in. and 0.75 in., with 0.33 in preferred, and its length l is between about 3 in. and 6 in. Diameter d and length l may, however, vary broadly, depending on firearm dimensions and the needs of the user. In some embodiments, the dimensions of the safety device 10 are sufficient to prevent dirt and other debris from entering the firing chamber 12 after insertion of the safety device 10 into the firearm 14. When the safety device 10 is so dimensioned, the need for mounting a dust cover over the ejection port may be eliminated.

The safety device 10 may generally be constructed of flexible materials. It is understood that materials for the safety device 10 of the present invention may also resist abrasion and cutting when the bolt exerts a force against the body 16 of the safety device 10. In addition, these materials may resist elongation when the user removes the safety device 10 from the firing chamber 12 with the bolt exerting force against the body 16 of the safety device 10. Resistance to cutting and abrasion also maintains the structural integrity of the body 16, particularly when the bolt 20 of the firearm 14 contains lugs (not shown), which appear on the forward portion of the bolt 20. Another aspect of the material used for the body 16 of the safety device 10 may include resistance to generation of particulates due to cutting or abrasion. Flakes or particles of material from which body 16 is formed may lodge in the internal mechanism of the firearm 14, causing jamming, or fouling of the mechanism. Additionally or alternatively, such materials may include other beneficial qualities, such as resistance to temperature changes.

Examples of materials suitable for use with the safety device 10 of the present invention include, but are not limited to silicone, TEFLON®, polymeric compounds, polyurethane polymers, thermal plastics or malleable metals. The material of the safety device 10 may also comprise a smooth exterior surface.

I claim:

1. A chamber disabling device for a firearm comprising:

an elongate body comprising a smooth continuous external surface extending radially about a length of the elongate body and extending from a first end to a second end, wherein the first end of the elongate body is positionable within a firing chamber of the firearm through a port which is in communication with the firing chamber and no portion of the of the elongate body is positioned further into the firing chamber than the first end, and wherein the elongate body is bendable between the first and second ends, such that the second end of the elongate body is positionable outside of the the port with the first end positioned in the firing chamber; and a ring member connected to the elongate body and extending from the second end of the chamber disabling device such that the ring member which defines an opening which has a length which extends in a direction of the length of the elongate body.

2. The chamber disabling device of claim 1, wherein at least a portion of the chamber disabling device is a florescent color.

3. The chamber disabling device of claim 1, wherein the chamber disabling device is constructed of at least one of a polyurethane polymer, thermal plastic, malleable metal and rubber material.

4. The chamber disabling device of claim 1, wherein the elongate body has a length defined between the first and second ends, and wherein the length is between about 3 inches and about 6 inches.

5. The chamber disabling device of claim 4, wherein the elongate body has a circular periphery with a diameter between about 0.25 inches and about 0.75 inches.

6. The chamber disabling device of claim 4, wherein the elongate body has a circular periphery with a diameter of about 0.33 inches.

7. The chamber disabling device of claim 1, wherein the chamber disabling device is solid throughout.

8. The chamber disabling device of claim 1, wherein at least a portion of the chamber disabling device is hollow.

9. The chamber disabling device of claim 1, wherein at least a portion of the elongate body has a shape complementary to a shape of the firing chamber to facilitate an interference fit between the elongate body and the firing chamber.

10. The chamber disabling device of claim 1, wherein the chamber disabling device is unitarily formed as one-piece.

11. The chamber disabling device of claim 1, wherein the elongate body has a first configuration prior to positioning the first end into the firing chamber and a second configuration different than the first configuration when the first end is positioned in the firing chamber, and wherein the first and second configurations of the chamber disabling device are facilitated by bending the elongate body.

* * * * *